US010368673B2

(12) United States Patent
Loeb et al.

(10) Patent No.: US 10,368,673 B2
(45) Date of Patent: Aug. 6, 2019

(54) LIQUID CONTAINING VESSELS WITH INTEGRATED COASTER

(71) Applicant: No Sweat, Inc., Venice, CA (US)

(72) Inventors: Jeremy Loeb, Venice, CA (US); Eric Bauswell, Eldridge, IA (US); Parker Drennan, San Jose, CA (US)

(73) Assignee: NO SWEAT, INC., Venice, CA (US)

( * ) Notice: Subject to any disclaimer, the term of this patent is extended or adjusted under 35 U.S.C. 154(b) by 197 days.

(21) Appl. No.: 15/807,234

(22) Filed: Nov. 8, 2017

(65) Prior Publication Data

US 2018/0125275 A1 May 10, 2018

Related U.S. Application Data

(60) Provisional application No. 62/418,972, filed on Nov. 8, 2016.

(51) Int. Cl.
*A47G 23/03* (2006.01)
*A47G 19/22* (2006.01)

(52) U.S. Cl.
CPC ..... *A47G 23/03* (2013.01); *A47G 19/22* (2013.01); *A47G 19/2255* (2013.01)

(58) Field of Classification Search
CPC ..... A47G 23/03; A47G 23/0216; A47G 19/2255; A47G 19/2205
See application file for complete search history.

(56) References Cited

U.S. PATENT DOCUMENTS 166,350 A * 8/1875 Dodge ..... A47G 19/2205 215/374
608,649 A * 8/1898 Christiansen ..... B65D 1/04 215/6
1,683,205 A * 9/1928 Packard ..... A47G 23/03 215/394
2,655,281 A * 10/1953 Davis ..... A47G 23/03 215/394
5,215,794 A * 6/1993 Johnson ..... A47G 19/12 215/12.2
2004/0007553 A1* 1/2004 Smolko ..... A41D 13/0053 215/12.1
2007/0092615 A1* 4/2007 Fisk ..... A47G 19/2205 426/416
2016/0360910 A1* 12/2016 Chiriga ..... A47G 19/2205
2017/0251853 A1* 9/2017 Chung ..... A47G 23/0216

* cited by examiner

*Primary Examiner* — Anthony D Stashick
*Assistant Examiner* — James R Way
(74) *Attorney, Agent, or Firm* — Ansari Katiraei LLP; Arman Katiraei; Sadiq Ansari

(57) ABSTRACT

Different liquid containing vessels with integrated coasters are provided. The liquid containing vessels have an upper portion, channel, base, and integrated coaster. The upper portion retains some amount of liquid. The channel is disposed beneath the upper portion and above the above the base. The channel is formed from a central stem connecting the upper portion to the base and a cavity that surrounds the stem for some radius that is less than a radius of the upper portion or base. Disposed in the channel is the integrated coaster. The integrated coaster is a trapping element that in some embodiments is a solid porous ring of an adsorptive or absorptive material. Condensation forming about the outer surface of the upper portion drips downwards towards the channel. The channel redirects the condensation to the trapping element where it is removed by the adsorptive or absorptive materials.

20 Claims, 9 Drawing Sheets

LIQUID CONTAINING VESSELS WITH INTEGRATED COASTER

CLAIM OF BENEFIT TO RELATED APPLICATIONS

This application claims the benefit of U.S. provisional application 62/418,972, entitled "Glassware and Plasticware Drinking Vessels with Integrated Coaster", filed Nov. 8, 2016. The contents of application No. 62/418,972 are hereby incorporated by reference.

TECHNICAL FIELD

The invention pertains to cups, pitchers, and other liquid containing vessels.

BACKGROUND ART

Condensation forms on the outside of glassware when water vapor in the air contacts and collects on the cooler outer surface of the glassware and converts from gaseous water vapor back into liquid droplets once a sufficient amount of condensation has collected on the outside of the glassware. The droplets slide down past the base and onto the surface (e.g., table) on which the glassware rests. The falling condensation can soak into the surface and cause damage depending on the material of the surface. Condensation is not unique to glassware and can also form on plastic liquid containing vessels, metallic (e.g., copper) liquid containing vessels, and liquid containing vessels of other materials.

Coasters address the issue of falling condensation. A coaster is typically a flat disc that is placed between the liquid containing vessel and the surface on which the liquid containing vessel is placed. The coaster is made of an absorbent material that soaks up the falling condensation before the condensation contacts the surface on which the liquid containing vessel is placed.

Coasters are inconvenient and aesthetically unpleasing, especially for formal dining. Accordingly, there is a need to prevent condensation from running off a liquid containing vessel onto furniture or other surfaces without placing a separate coaster underneath the liquid containing vessel. Stated differently, there is a need to integrate coaster functionality as part of the liquid containing vessel in a manner that does not ruin the aesthetic look of the liquid containing vessel or the functionality of the liquid containing vessel. There is further a need for such a liquid containing vessel with an integrated coaster to be reusable and dishwasher safe all while looking and feeling like traditional liquid containing vessels without the integrated coaster.

BRIEF DESCRIPTION OF THE DRAWINGS

A preferred embodiment for liquid containing vessels with an integrated coaster will now be described, by way of example only, with reference to the accompanying drawings in which.

DETAILED DESCRIPTION

Liquid containing vessels with an integrated "coaster" are disclosed. The integrated coaster prevents condensation and other liquid from pooling at the base of or underneath the vessel and from transferring to furniture or other surfaces onto which the vessels are placed. In particular, the liquid containing vessels incorporate a trapping element in various forms. The trapping element traps about a base of the vessel the condensation that forms and drips about the outside of the vessel. In some embodiments, the trapping element is a highly porous adsorptive material that adheres to individual condensation droplets upon contact. In some other embodiments, the trapping element is an absorptive material into which the condensation droplet dissolve or soak upon contact. In this manner, the liquid containing vessels with the integrated coaster prevent the condensation from dripping past and under the vessel base, thereby eliminating the need for a separate coaster.

Different embodiments of the liquid containing vessel with integrated coaster include liquid containing vessels made of different materials such as glass, metal (e.g., copper, stainless steel, etc.), and plastic as some examples. The embodiments further include liquid containing vessels with an integrated coaster having different shapes, uses, or applications including wine glasses, tumblers, mugs, pitchers, carafes, decanters, thermoses, water bottles, and other liquid containing vessels of different shapes (e.g., rectangular, cylindrical, bulbous, etc.) and sizes (e.g., 4 ounces, 8 ounces, 16 ounces, 1 gallon, etc.). The liquid containing vessels with integrated coaster can be washed, dried, and re-used without losing the ability to trap condensation with the integrated coaster. In many embodiments, the liquid containing vessels are dishwasher safe.

In some embodiments, the liquid containing vessels with integrated coaster have a liquid containing volume upper portion, a lower portion base, a channel between the upper portion and the lower portion, and a trapping element inset within the channel. Condensation that forms about the outer surface of the upper portion flows downward and into the channel. The channel is curved or otherwise shaped to redirect the condensation from the outer surface of the upper portion to make contact with the trapping element. The trapping element comprises an adsorptive or absorptive material that removes the condensation from the outer surface of the vessel by adhering to the condensation (i.e., adsorption) or by soaking the condensation (i.e., absorption). Consequently, the base and surface underneath the liquid containing vessel remains dry at all times. The trapping element thereby prevents the condensation from dripping on the surface or on the person using the liquid containing vessel with integrated coaster.

Figure 1:
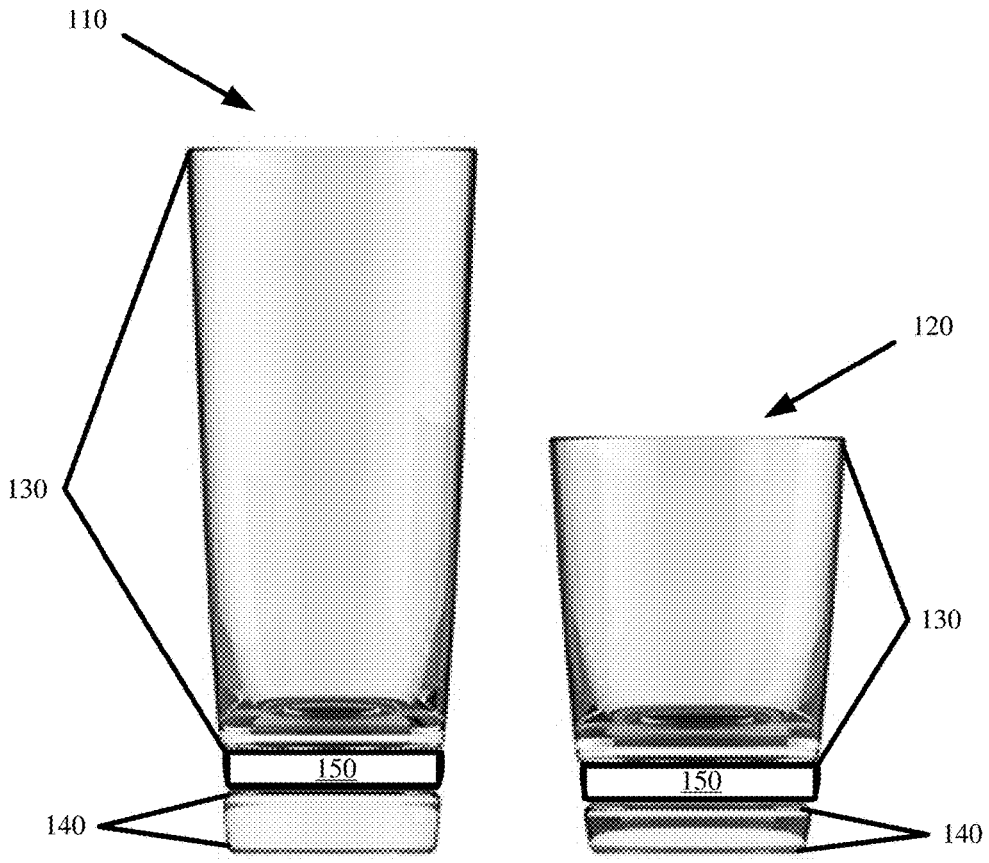
FIG. 1 illustrates the liquid containing vessel with integrated coaster as tall and short tumbler glasses in accordance with some embodiments.

FIG. 1 illustrates the liquid containing vessel with integrated coaster as tall and short tumbler glasses 110 and 120 in accordance with some embodiments. Each tumbler 110 and 120 has the liquid containing volume upper portion 130, lower portion base 140, and trapping element 150 inset within a channel.

In some embodiments, the liquid containing volume upper portion is formed to resemble the upper portions of traditional glassware without an integrated coaster. This is a volume that retains some amount of liquid whether for drinking, pouring, or other purposes. The upper portion can have a variety of shapes, sizes, and dimensions.

Directly underneath the upper portion is the channel. The channel is a cylindrical cavity surrounding a stem or gasket that connects the upper portion to the base. The channel is formed by leaving exposed a distance between the outer circumference of the drinking vessel and the center of the drinking vessel. More specifically, the cylindrical cavity has a radius or width that is less than a radius or width of either the upper portion or base. In some embodiments, the bottom edge of the upper portion is curved so as to redirect the condensation from the outer surface of the upper portion into the channel towards the stem or gasket. In some other embodiments, the bottom edge of the upper portion is flat so as to provide a straight, albeit potentially angled, transition to the channel.

The base is directly below the channel. In some embodiments, the base is formed to resemble the base of traditional glassware without an integrated coaster. The base provides stability when resting the vessel atop a flat surface. In particular, the base holds the vessel upright when placed atop a flat surface such as a table, bar, or other furniture.

In some embodiments, the trapping element is formed in the shape of the exposed cavity of the channel so that the trapping element fits flush within the channel. In other words, the outer circumference of the trapping element aligns with the outer circumferences of the upper portion and base regardless of the shape upper portion or base (e.g., cylindrical, conical, bulbous, rectangular, etc.). In preferred embodiments, the trapping element is in the form of a ring or disc so as to match the cylindrical or conical shape of most glassware.

Figure 2:
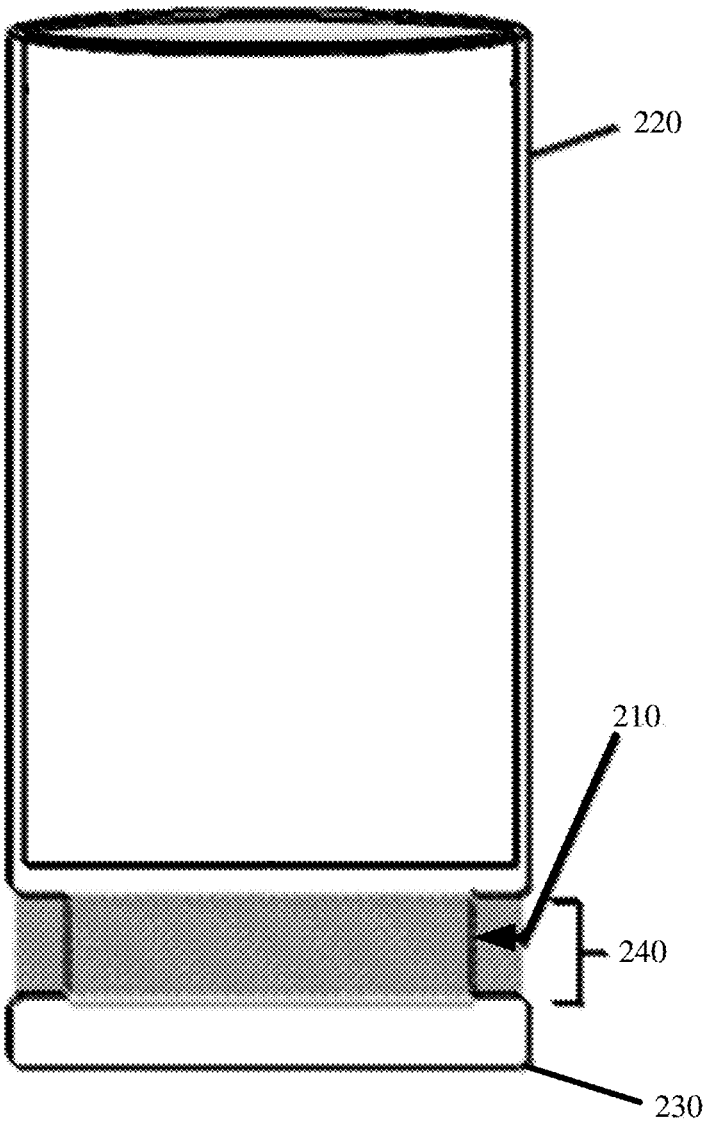
FIG. 2 provides a detailed view of the channel and integration of the trapping element within the channel.

FIG. 2 provides a detailed view of the channel and integration of the trapping element within the channel. In this figure, a stem 210 connects the upper portion 220 to the base 230 of the liquid containing vessel. The stem 210 has an outer circumference that is less than the outer circumference of either the upper portion 220 or base 230. The stem 210 can be circular, rectangular, or any other shape. The distance from the outer circumference of the stem 210 to the outer circumference of the upper portion 220 or base 230 is the channel cavity. Inset within the channel is the trapping element illustrated by the shaded disc 240. The stem 210 is typically made of the same material as the upper portion 220 or base 230 of the liquid containing vessel. However, in some embodiments, a gasket is added to or replaces the stem 210 to better prevent thermal transfer from the upper portion 220 to the base 240 where the two are directly connected to one another without the trapping element 240 in between.

In FIG. 2 and other embodiments, the trapping element is a ring, disc, or torus with a central opening. The central opening has a radius about equal to the stem (i.e., the radius of the solid portion of the drinking vessel that is surrounded by the channel) so as to fit around and be retained by the stem. The solid portion of the ring, disc, or torus contains an adsorptive or absorptive material with a radius about equal to the channel cavity. The outer circumference of the trapping element is similar to the outer circumferences of the upper portion and base in order to provide a seamless and smooth transition between the structures. Any condensation that forms on the outer surface of the upper portion and drips down will make contact with the trapping element with the condensation becoming entrapped by the adsorptive or absorptive material.

The width and height of the channel and trapping element vary between the different embodiments. A wider channel with a wider trapping element will allow the trapping element to have more of the adsorptive or absorptive material such that the trapping element can remove and trap greater amounts of condensation. Similarly, a taller channel and taller trapping element will increase the amount of the adsorptive or absorptive material, and thereby the amount of condensation that can be removed and trapped by the trapping element. The height of the channel and trapping element also affects the speed with which the trapping element dries. The greater height exposes more surface area of the trapping element to the open air. The trapping element is porous in nature such that the greater the amount of air coming into contact with the trapping element, the faster the evaporation of the trapped condensation will take place. The width and the height of the channel and trapping element can range between ⅛ to 1 inch for drinking glassware and even larger widths and heights (i.e., up to 2 inches) for the channels and trapping elements of pitchers, decanters, and other larger volume liquid containing vessels.

Figure 3:
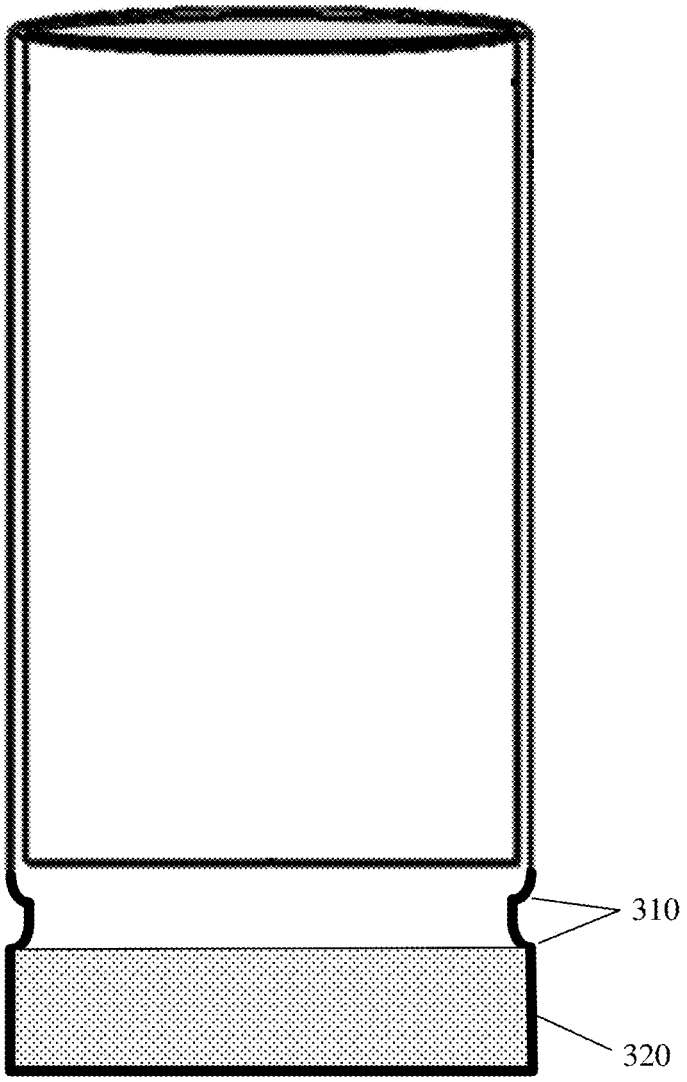
FIG. 3 illustrates a liquid containing vessel of some embodiments with the adsorptive or absorptive material of the trapping element integrated into the vessel base.

In some other embodiments, the trapping element is integrated into the vessel base instead of being inset in the channel. In other words, the base contains the adsorptive or absorptive material. FIG. 3 illustrates a liquid containing vessel with the adsorptive or absorptive material of the trapping element integrated into the vessel base. Here, the channel 310 directs the condensation into the vessel base 320. The top of the vessel base 320 is permeable so as to allow the condensation into the center of the base 320 where it is collected by the adsorptive or absorptive material therein.

In still some other embodiments, the trapping element is a solid that is the base or a significant part of the base. In other words, the trapping element is directly attached to the upper portion of the vessel without a stem.

In preferred embodiments, the trapping element is comprised of an adsorptive material. The adsorptive material is porous with a pore size ranging from 1 to 10 microns in size. The adsorptive material adheres to the molecules of the condensate, whereas the absorptive material contains microscopic chambers into which the molecules of the condensate are captured and retained. The adsorptive material is preferred to the absorptive material because the adsorptive material retains its shape and dimensions whether dry or trapping condensation, whereas the absorptive materials is sponge-like and will likely deform when changing from a dry state to a soaked state. The adsorptive material is more durable and rigid than absorptive materials, therefore being more suited to withstanding washing and drying in a dishwasher. Also, the adsorptive material can be easily formed into solids of different shapes such as the aforementioned ring or disc. The adsorptive material can be a ceramic. A particular ceramic providing the desired adsorptive properties is porous aluminum oxide, alumina, or activated alumina. In some embodiments, the adsorptive material can also comprise one or more of alumina silica, ceramic foam, carbon compounds, zeolites, or other microporous or irreversible adsorbents in different combinations with each other or various ceramics.

In some embodiments, the trapping element is comprised of an absorptive material. Silica gel, absorbent polymers, natural or synthetic sponges, and diatomaceous earth, are examples of absorptive materials for the trapping element of some embodiments. In some embodiments, the trapping element is comprised of a combination of the above enumerated adsorptive and absorptive materials and materials with similar properties, such as cordierite and mullite.

The particulates or granules for the adsorptive or absorptive materials can be baked to produce the trapping element in a solid form such as a ring or torus as described above. The particulates or granules can also be contained in a separate permeable structure that the condensate can penetrate. As described in detail below, the granules or particulates can also coat the outer surface of the liquid containing vessel of some embodiments.

Figure 4A:
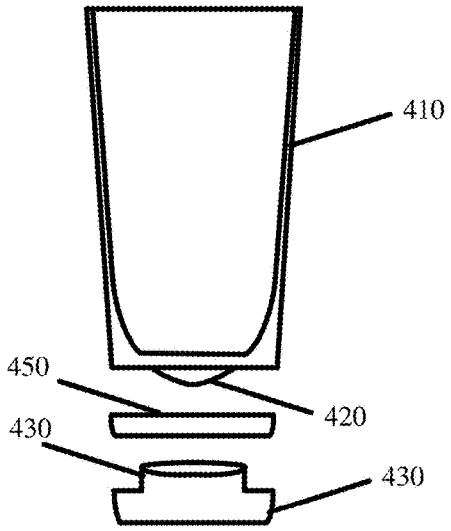
FIGS. 4A and 4B provide different exploded views of a liquid containing vessel with integrated coaster in accordance with some embodiments.
Figure 4B:
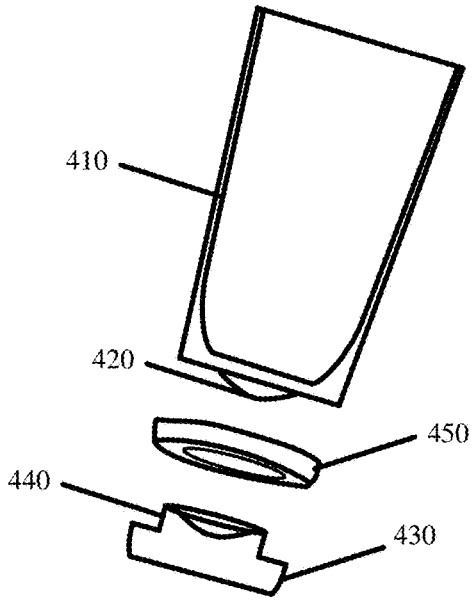
Figure 4C:
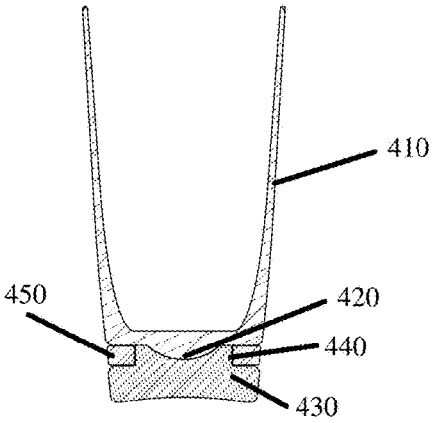
FIG. 4C illustrates the assembled liquid containing vessel with integrated coaster from FIGS. 4A and 4B.

FIGS. 4A and 4B provide different exploded views of a liquid containing vessel with integrated coaster in accordance with some embodiments. The exploded views illustrate one manufacturing technique for integrating the trapping element into the channel of the liquid containing vessel in accordance with some embodiments. FIG. 4C illustrates the assembled liquid containing vessel with integrated coaster from FIGS. 4A and 4B.

In FIGS. 4A-4C the upper portion 410 is illustrated with a downward protrusion 420. The base 430 is illustrated with an upward protrusion 440 having an indentation of similar size to the downward protrusion 420 of the upper portion 410. The trapping element 450 is an adsorptive or absorptive material formed into a ring, disc, or torus with a central opening of about equal size to the upward protrusion 440 of the base 430. The trapping element 450 is placed over the upward protrusion 440 and is held in place. The downward protrusion 420 of the upper portion 410 is then aligned with the indentation of the upward protrusion 440 from the base 430. A strong adhesive (not shown) is placed on one or both of the downward protrusion 420 and indentation. With the adhesive applied, the upper portion 410 is affixed to the base 430 by lowering the downward protrusion 420 directly into the indentation of the base 430. Consequently, the adhesive adheres the upper portion 410 to the base 430 with the solid ring, disc, or torus of the integrated coaster (i.e., trapping element 450) disposed between. In some embodiments, a gasket may be disposed between the downward protrusion 420 and the upward protrusion 440 to prevent thermal transfer between the two.

In some embodiments, the adhesive is an epoxy that is optically clear, ultra violet stable, and able to withstand temperatures up to 100 degrees Celsius. Several such glass glues are available and can be used. In some embodiments, the adhesive also has insulating properties. The insulating properties prevent thermal transfer from the upper portion to the base through the stem connecting the two structures. The insulating properties prevents the upper portion from chilling the base, whereby chilling the base could lead to condensation forming about the outer surface of the base and below the trapping element. The insulation provided by the adhesive prevents even a small amount of thermal transfer to the base or chilling of the base. As noted above, a gasket can be used in addition to the stem or as a replacement for the stem to further assist in preventing the thermal transfer where the top and bottom portions of the vessels directly connect to one another.

Figure 5:
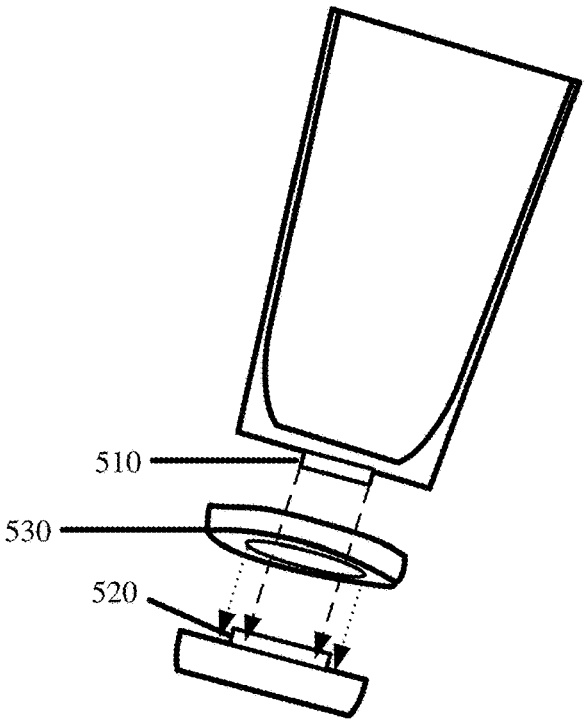
FIG. 5 illustrates the upper portion of the liquid containing vessel having a downward extending first ring or cylinder with a first radius, and the base having a concentric upward extending second ring or cylinder with a different second radius in accordance with some embodiments.

FIGS. 5-10 provide exploded views for alternate constructions of the liquid containing vessel with integrated coaster in accordance with some embodiments. In accordance with some embodiments, FIG. 5 illustrates the upper portion of the liquid containing vessel having a downward extending first ring or cylinder 510 with a first radius, and the base having a concentric upward extending second ring or cylinder 520 with a different second radius. In this figure, the first radius is smaller than the second radius. Accordingly, the first ring or cylinder 510 acts as an inner wall and the second ring or cylinder acts 520 as an outer wall for containing the trapping element 530, whether in solid form or as granules.

In some embodiments, the height of the second ring or cylinder 520 is less than the height of the first ring or cylinder 510 so as to create a small channel about the outer surface of the liquid containing vessel. The channel redirects condensation dripping down the outer surface of the upper portion into the adsorptive or absorptive materials of the trapping element 530. Adhesive is placed on at least one of the lip of the first ring or cylinder 510 and lip of the second ring or cylinder 520 such that when the structures are brought together with the trapping element 530 in between, they become affixed as one structure.

In some embodiments, the second ring or cylinder 520 is modified to be a hollowed stem with upward extending retaining walls. In some such embodiments, the first ring or cylinder 510 passes through the central opening of the trapping element 530 and is inset within upward extending retaining walls 520 of the base with the central opening of the trapping element 530 passing over and around the retaining walls 520. In other words, the first ring or cylinder 510 of the upper portion becomes a stem that fits firmly within the retaining walls 520 of the base. Once again, a clear glass adhesive may be used to affix the structures together.

Figure 6:
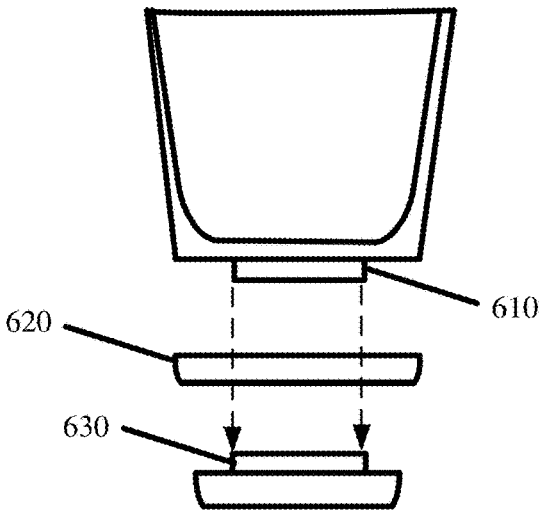
FIG. 6 illustrates the base being modified to include a stem that extends upwards to match a stem extending downwards from the upper portion in accordance with some embodiments.

In accordance with some embodiments, FIG. 6 illustrates the base being modified to include a stem 610 that extends upwards to match a stem 620 extending downwards from the upper portion. The central opening of the trapping element 630 is placed through the stems 610 and 620. The stem 620 from the upper portion is aligned and placed directly atop the stem 610 of the base with adhesive affixing the two together 610 and 620.

Figure 7:
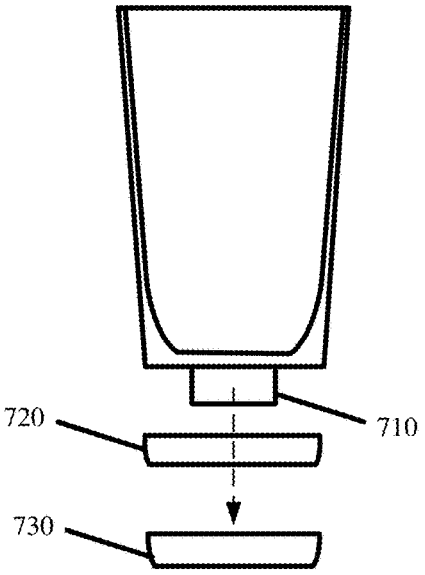
FIG. 7 illustrates the upper portion having a single downward extending stem that passes through the trapping element and that attaches to the base with an adhesive or epoxy in accordance with some embodiments.

FIG. 7 illustrates the upper portion having a single downward extending stem 710 that passes through the trapping element 720 and that attaches to the base 730 with an adhesive or epoxy in accordance with some embodiments. In this assembly, the base 730 does not have a stem and is a flat surface upon which the upper portion stem 710 is adhered. The upper portion stem 710 retains the trapping element 720 in place once the vessel is assembled.

Figure 8:
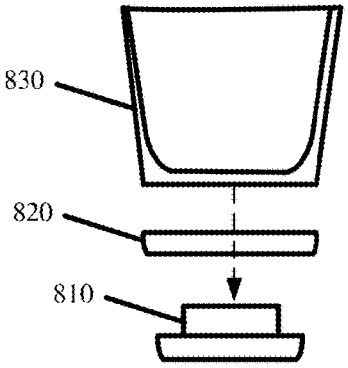
FIG. 8 illustrates the base having a single upward extending stem that passes through the trapping element and that attaches to the upper portion with an adhesive or epoxy in accordance with some embodiments.

FIG. 8 illustrates the base having a single upward extending stem 810 that passes through the trapping element 820 and that attaches to the upper portion 830 with an adhesive or epoxy in accordance with some embodiments. FIG. 8 is an inverse assembly of FIG. 7 in which the base stem 810 retains the trapping element 820 in place once the vessel is assembled. The upper portion 830 does not have a stem and provides a flat surface underneath against which the base stem 810 is adhered.

Figure 9:
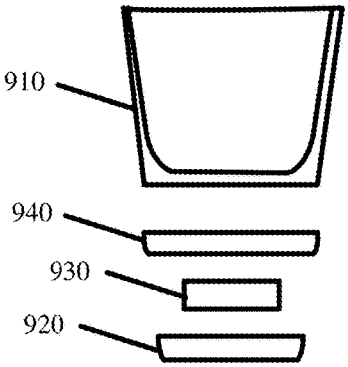
FIG. 9 illustrates a liquid containing vessel of some embodiments with an upper portion attaching to the base with a gasket serving as the connecting stem between the two.

FIG. 9 illustrates a liquid containing vessel of some embodiments with an upper portion 910 attaching to the base 920 with a gasket 930 serving as the connecting stem between the two. The gasket 930 can be rubber block or other material with properties that prevent thermal transfer. The gasket 930 has a height slightly taller than or equal to the trapping element 940. The trapping element 940 has a central cavity in the shape of gasket 930 so that the trapping element 940 can be placed over and around the gasket 930. An adhesive is applied to either side of the gasket 930 in order to affix the upper portion 910 to the base 920 with the trapping element 940 inset between the two structures.

Figure 10:
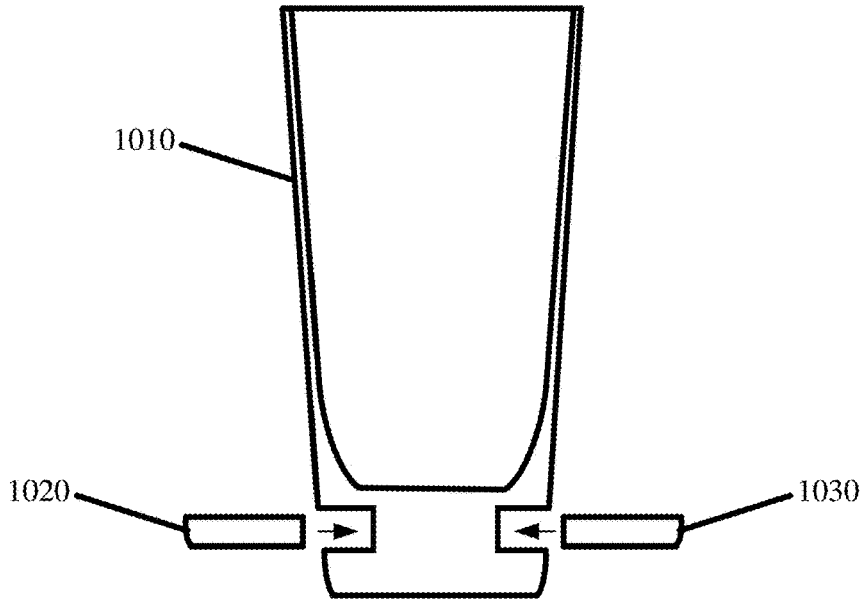
FIG. 10 illustrates the drinking vessel as a single unitary structure in accordance with some embodiments.

In accordance with some embodiments, FIG. 10 illustrates the drinking vessel 1010 as a single unitary structure. Here, the drinking vessel 1010 is a single piece of glass blown and formed with the upper liquid containing volume, the channel, and the base. The trapping element is separated into two halves 1020 and 1030. The halves 1020 and 1030 are placed inside the channel and affixed together with an adhesive.

FIGS. 5-10 illustrate various manufacturing processes for the liquid containing vessel with integrated coaster of some embodiments. Other manufacturing processes can be used to integrate the trapping element within the lower or bottom portion of the liquid containing vessel.

In some embodiments, the adsorptive or absorptive is turned into fine granules that are coated about the outer surface of the liquid containing vessel. In some such embodiments, a clear adhesive is spread across the outer surface of the drinking vessel and fine particulates of the adsorptive or absorptive material are uniformly applied. The particulates adhere to the outer surface and trap the condensation dripping from above upon contact.

Figure 11:
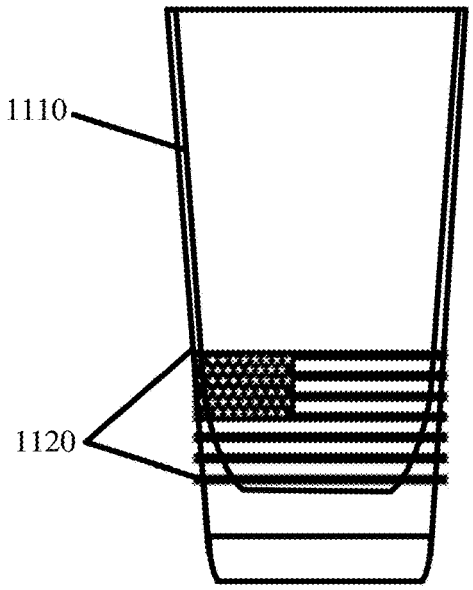
FIG. 11 conceptually illustrates integrating a coaster with a liquid containing vessel by coating a lower portion of the exterior of the liquid containing vessel with adsorptive or absorptive particulates in accordance with some embodiments.

In some such embodiments, the particulates can be adhered to not only provide the utility of trapping the condensation before it drips to the bottom of the liquid containing vessel, but also to provide a design aesthetic or custom logo. FIG. 11 conceptually illustrates integrating a coaster with a liquid containing vessel 1110 by coating a lower portion of the exterior of the liquid containing vessel 1110 with adsorptive or absorptive particulates 1120 in accordance with some embodiments. The adhesive is first applied in the desired shape or pattern. The particulates 1120 are then applied over the adhesive such that the particulates 1120 adhere to the outer surface of the liquid containing vessel in the desired shape or pattern. In FIG. 11, the particulates 1120 are adhered to the vessel in the form of the American flag.

Although the figures above illustrate the liquid containing vessel with integrated coaster as glassware, other embodiments provide the same utility and structures with liquid containing vessels made of plastic, metallic, ceramic, or materials. Similarly, the utility and structures can be carried over in manufacturing pitchers, carafes, decanters, thermoses, water bottles, and other liquid containing vessels.

Figure 12:
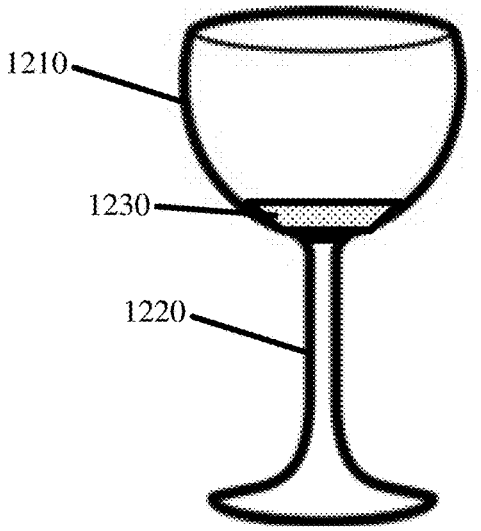
FIG. 12 illustrates a wine glass with integrated coaster in accordance with some embodiments.

FIG. 12 illustrates a wine glass 1210 with integrated coaster in accordance with some embodiments. The wine glass 1210 has a channel above the glass stem 1220. The trapping element 1230 is inset within the channel. The wine glass 1210 can be blown or molded as a single structure. Alternatively, the wine glass 1210 can include a separate liquid containing upper portion with a connecting stem that is adhered to the glass stem 1220 with an adhesive.

Figure 13:
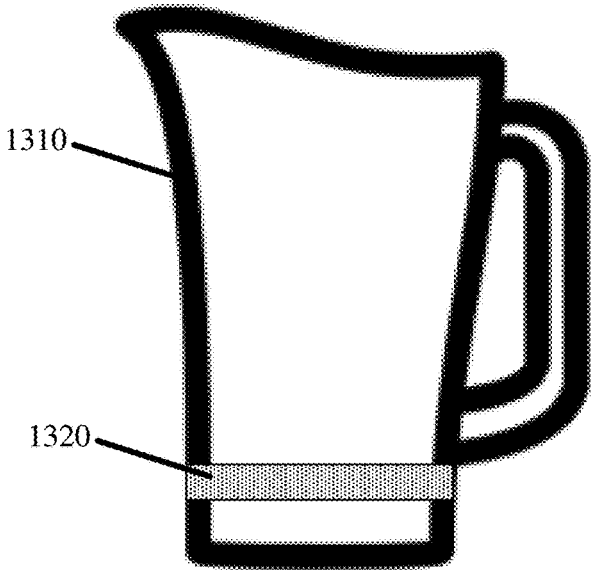
FIG. 13 illustrates a pitcher with integrated coaster in accordance with some embodiments.

FIG. 13 illustrates a pitcher 1310 with integrated coaster in accordance with some embodiments. The pitcher 1310 has a channel between the liquid containing volume upper portion and base. A trapping element 1320 is once again inset in the channel to trap and remove condensation forming and dripping down the outer surface of the upper portion.

In some embodiments, the trapping element is provided as a removable accessory that can be interchangeable used with different liquid containing vessels. In some such embodiments, the removable trapping element comprises a flexible and elastic outer casing. The outer casing is cylindrical or in the shape of a ring. However, the elasticity of the outer casing allows the removable trapping element to take many forms, and more importantly, the form of the vessel onto which the removable trapping element is placed. The outer casing contains particulates of one or more of the adsorptive or absorptive materials. The outer casing is permeable to permit condensate from entering into the trapping element, but still prevent the adsorptive or absorptive material from spilling out.

Figure 14A:
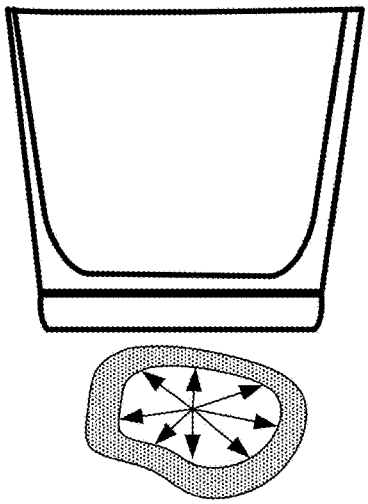
FIGS. 14A, 14B, and 14C conceptually illustrate application of a removable trapping element to a traditional glass without an integrated coaster in accordance with some embodiments.
Figure 14B:
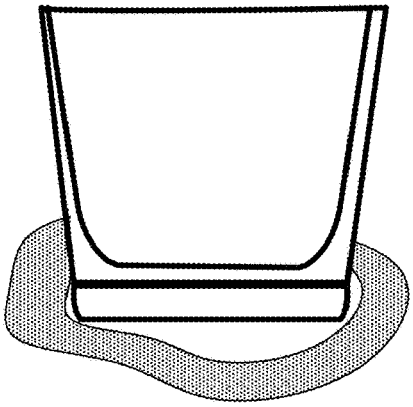
Figure 14C:
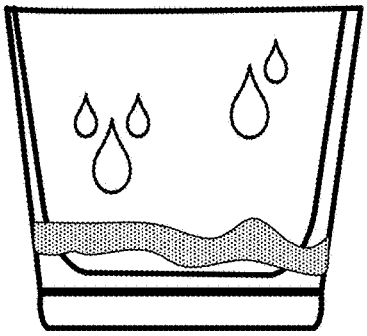

FIGS. 14A, 14B, and 14C conceptually illustrate application of a removable trapping element to a traditional glass without an integrated coaster. FIG. 14A illustrates expanding the central opening of the removable trapping element by stretching the various ends. FIG. 14B illustrates inserting the glass through the stretched opening of the removable trapping element. FIG. 14C illustrates the removable trapping element contracting around the glass in order to retain its position about the glass. Condensation forming and dripping about the outer surface of the glass will contact the removable trapping element. Since the trapping element is permeable, the droplets will enter the encasing where they are adhered to the adsorptive particulates or are absorbed by the absorptive particulates therein.

The removable trapping element can be different sizes to accommodate vessels with larger and smaller bases. The removable trapping element can also be used to replace the solid trapping element when coupled with the liquid containing vessels depicted above having a channel. In some such embodiments, the removable trapping element is stretched and placed into the channel. The removable trapping element can then be removed or changed as needed without ruining the aesthetic of the vessel as the trapping element expands over the base of the vessel and contracts to fit securely within the channel.

We claim:

1. A liquid containing vessel with integrated coaster, the vessel comprising:

an upper portion comprising a liquid containing volume;

a base below said upper portion, the base retaining the vessel upright over a surface;

a channel between the upper portion and said base, the channel comprising a cavity extending centrally from an outer circumference of the base by a particular distance that is less than a width or radius of the base; and a trapping element disposed in said channel, the trapping element comprising a plurality of ceramic particulates baked to form a rigid, solid, and dishwasher safe permeable structure with a plurality of pores providing a plurality of nondeforming chambers with which to adsorb condensate from the outer face of the upper portion without modifying shape or dimensions of the plurality of nondeforming chambers or the plurality of ceramic particulates.

2. The vessel of claim 1 further comprising a stem connecting the upper portion to the base, the stem having a width or radius less than a width or radius of the upper portion and the base, and wherein the stem is at a center of the channel.

3. The vessel of claim 2, wherein the trapping element further comprises a central opening with a width or radius about equal to the width or radius of the stem, and wherein the stem extends through the central opening of the trapping element.

4. The vessel of claim 3 further comprising an optically clear adhesive or epoxy between the upper portion and the base, said adhesive or epoxy affixing the upper portion to the base.

5. The vessel of claim 4, wherein said trapping element is free of said adhesive or epoxy.

6. The vessel of claim 2, wherein the rigid, solid, and dishwasher safe permeable structure of the trapping element comprises at least a first half with a first plurality of ceramic particulates baked to a solid and rigid first form, and a separate second half with a second plurality of ceramic particulates baked to a solid and rigid second form, wherein the first half connects to the second half around said stem with an adhesive.

7. The vessel of claim 1, wherein the upper portion further comprises a protrusion extending below the liquid containing volume, wherein the protrusion has a width or radius that is less than a width or radius of a bottommost section of the upper portion, wherein a width or radius of the channel combined with the width or radius of the protrusion is equal to the width or radius of the bottommost section of the upper portion.

8. The vessel of claim 7, wherein the base comprises a segment with an indentation aligning with the protrusion of the upper portion, said segment extending upwards from the base, wherein the indentation has a width or radius equal to the width or radius of the protrusion, said indentation receiving the protrusion and retaining the upper portion vertically from said base.

9. The vessel of claim 7, wherein the base comprises a cylindrical wall with a central cavity extending upwards from a topmost section of the base, wherein the central cavity has a width or radius equal to the width or radius of the protrusion, and wherein the cylindrical wall retains the upper portion upright in response to disposing the protrusion within the central cavity of the cylindrical wall.

10. The vessel of claim 1, wherein the plurality of ceramic particulates comprise one or more particulates of aluminum oxide, alumina, or activated alumina.

11. The vessel of claim 10, wherein the plurality of ceramic particulates further comprise at least one of alumina silica, ceramic foam, carbon compounds, and zeolites.

12. The vessel of claim 1, wherein the trapping element further comprises absorptive materials that modify shape or dimensions in response to changing from a dry state to wet state after absorbing condensate from the outer face of the upper portion, the absorptive materials comprising at least one of silica gel, absorbent polymers, natural or synthetic sponges, and diatomaceous earth.

13. A condensation trapping liquid containing vessel comprising:

an upper portion comprising a liquid containing volume with an opening at a top side and enclosed about all other sides;

a base below said upper portion; and a ceramic porous solid ring attached to said base, the ceramic porous solid ring comprising a plurality of microscopic chambers created from a fixed and rigid arrangement of a plurality of ceramic alumina particulates, wherein one or more chambers of the plurality of microscopic chambers remove condensate from an outer surface of the vessel without modifying a shape or dimensions of the ring in response to said condensate forming on the outer surface of the upper portion and dripping down until contacting the one or more chambers of the plurality of microscopic chambers.

14. The vessel of claim 13, wherein an outer circumference of the ceramic porous solid ring is aligned with outer circumferences of the upper portion and the base.

15. The vessel of claim 13, wherein the ceramic porous solid ring has a width between ⅛ inches to 1 inch.

16. The vessel of claim 13, wherein the ceramic porous solid ring has a height between ⅛ inches to 1 inch.

17. The vessel of claim 13, wherein said vessel is a drinking cup, and wherein the upper portion and the base are made of glass, plastic, or metal.

18. The vessel of claim 13, wherein said vessel is a pitcher, decanter, or carafe, and wherein the upper portion further comprises a handle connected at two points about the outer face of the upper portion.

19. The vessel of claim 13, wherein the plurality of ceramic alumina particulates comprise one or more particulates of aluminum oxide, alumina, or activated alumina.

20. The vessel of claim 1, wherein the plurality of nondeforming chambers provided by the plurality of pores are between 1 and 10 microns in size.

* * * * *